US008398444B2

(12) United States Patent
Colautti

(10) Patent No.: US 8,398,444 B2
(45) Date of Patent: Mar. 19, 2013

(54) NAUTICAL ENGINE FOR BOATS WITH JET PROPULSION BY COMBUSTION GASES

(76) Inventor: Elio Colautti, Trieste (IT)

( * ) Notice: Subject to any disclaimer, the term of this patent is extended or adjusted under 35 U.S.C. 154(b) by 146 days.

(21) Appl. No.: 13/054,204

(22) PCT Filed: Jul. 17, 2008

(86) PCT No.: PCT/IT2008/000480

§ 371 (c)(1),
(2), (4) Date: Jan. 14, 2011

(87) PCT Pub. No.: WO2009/078049

PCT Pub. Date: Jun. 25, 2009

(65) Prior Publication Data

US 2011/0113750 A1 May 19, 2011

(51) Int. Cl.
*B63H 11/14* (2006.01)

(52) U.S. Cl. ..... 440/45; 60/221

(58) Field of Classification Search ..... 440/45; 60/221

See application file for complete search history.

(56) References Cited

U.S. PATENT DOCUMENTS

| | | | | |
|---|---|---|---|---|
| 2,644,297 | A | 7/1953 | Coxe et al. | |
| 2,714,800 | A | 8/1955 | Gongwer | |
| 3,107,486 | A | 10/1963 | Linderfelt | |
| 3,157,992 | A * | 11/1964 | Kemenczky | 60/221 |
| 3,279,178 | A * | 10/1966 | Kemenczky | 60/221 |
| 4,057,961 | A * | 11/1977 | Payne | 60/221 |
| 4,934,331 | A * | 6/1990 | Pommer | 123/587 |

FOREIGN PATENT DOCUMENTS

| | | |
|---|---|---|
| GB | 1066236 | 4/1967 |
| GB | 1 345 627 | 1/1974 |

* cited by examiner

*Primary Examiner* — Stephen Avila

(74) *Attorney, Agent, or Firm* — Birch, Stewart, Kolasch & Birch, LLP

(57) ABSTRACT

A nautical engine comprising at least one combustion chamber provided with a first opening for feeding an air and fuel mixture, at least one spark plug for igniting the mixture, at least one second opening for exhausting the exhaust gas derived from the ignition of the mixture, a device adapted to feed at least one combustion chamber by the at least one first opening, a control device adapted to control the feeding device for feeding the mixture into the combustion chamber and for igniting the spark plug for igniting the mixture. The feeding device comprises a nozzle adapted to spray the mixture at a pressure to open the first valve of the chamber, and, after having closed the first opening of the first valve, the second valve, for exhausting the gas, can be opened by the gas produced by the ignition of the mixture in the combustion chamber.

6 Claims, 6 Drawing Sheets

NAUTICAL ENGINE FOR BOATS WITH JET PROPULSION BY COMBUSTION GASES

The present invention relates to a nautical engine for boats.

Nautical engines for propelling boats are known in the prior art. Water-jet propulsion systems are also known. Said systems normally use water jet propeller pumps, are used on small boats and allow high speeds and high maneuverability of the boats.

Said propulsion systems are however very complicated and costly.

In view of the described prior art, it is the object of the present invention to provide a nautical engine for boats which is more simple than those known.

In accordance with the present invention, such an object is reached by means of a nautical engine comprising at least one combustion chamber provided with a first opening, normally closed by a first valve, for feeding the air and fuel mixture, at least one spark plug for igniting the mixture, at least one second opening, normally closed by a second valve, for exhausting the exhaust gas deriving from the ignition of the mixture, means adapted to feed at least said combustion chamber by means of said at least one first opening, a control device adapted to control said feeding means for feeding the mixture into the combustion chamber and for igniting the spark plug for igniting the mixture, characterized in that said feeding means comprise a nozzle adapted to spray said mixture at a pressure such as to open said first valve of the chamber and in that, after having closed said first opening of the first valve, said second valve for exhausting the gas can be opened by the gas produced by the combustion of said mixture in the combustion chamber, said combustion chamber being integral with at least one propulsion tube immersed in water and to which the gas from the combustion chamber leads for compressing and expelling the water present in at least one propulsion tube after having closed said second opening of the second valve.

Said engine has very low consumption because it is not necessary to feed a pump for the water jet propeller. Furthermore, said engine does not consume oil because no pistons or cylinders are used.

The features and the advantages of the present invention will be apparent from the following detailed description of a practical embodiment thereof, shown by way of non-limitative example in the accompanying drawings, in which.

Figure 1:
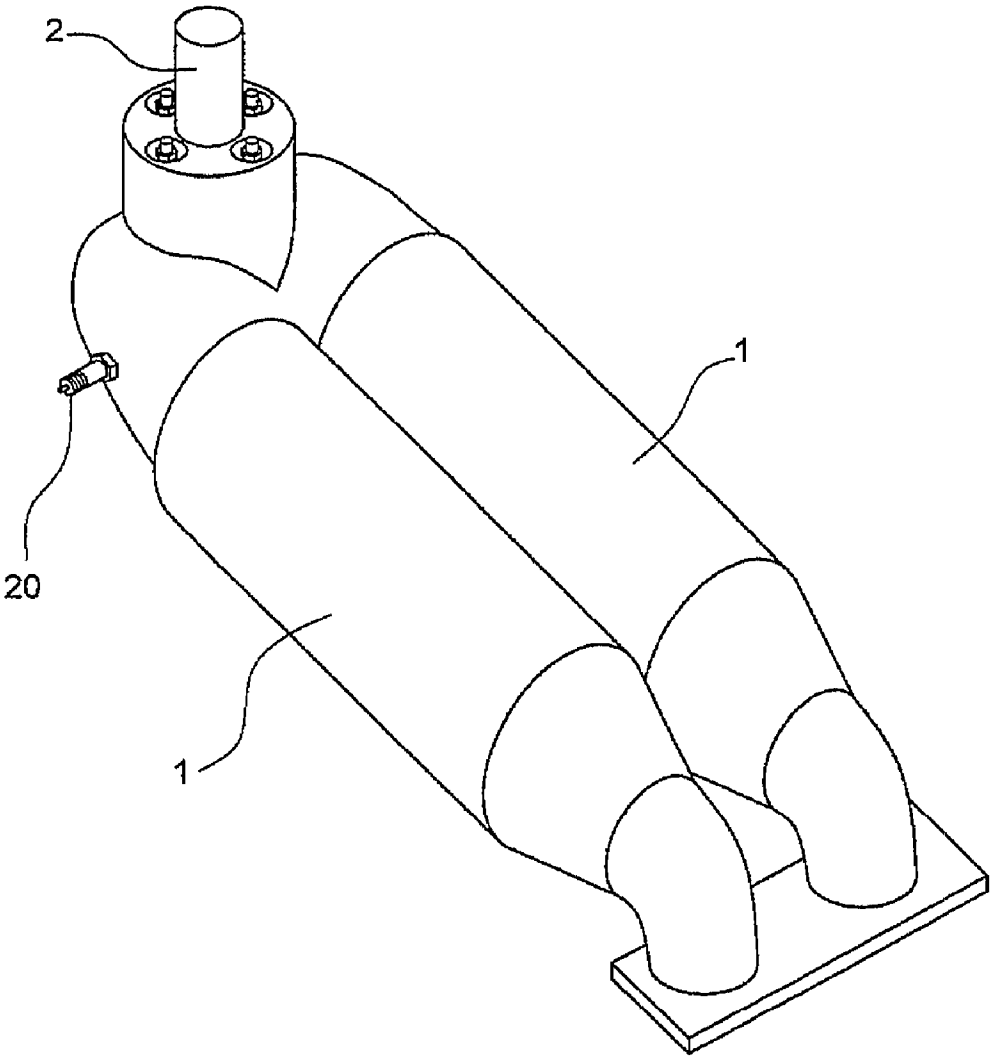
FIG. 1 is a perspective view of a part of the nautical engine according to the present invention.
Figure 2:
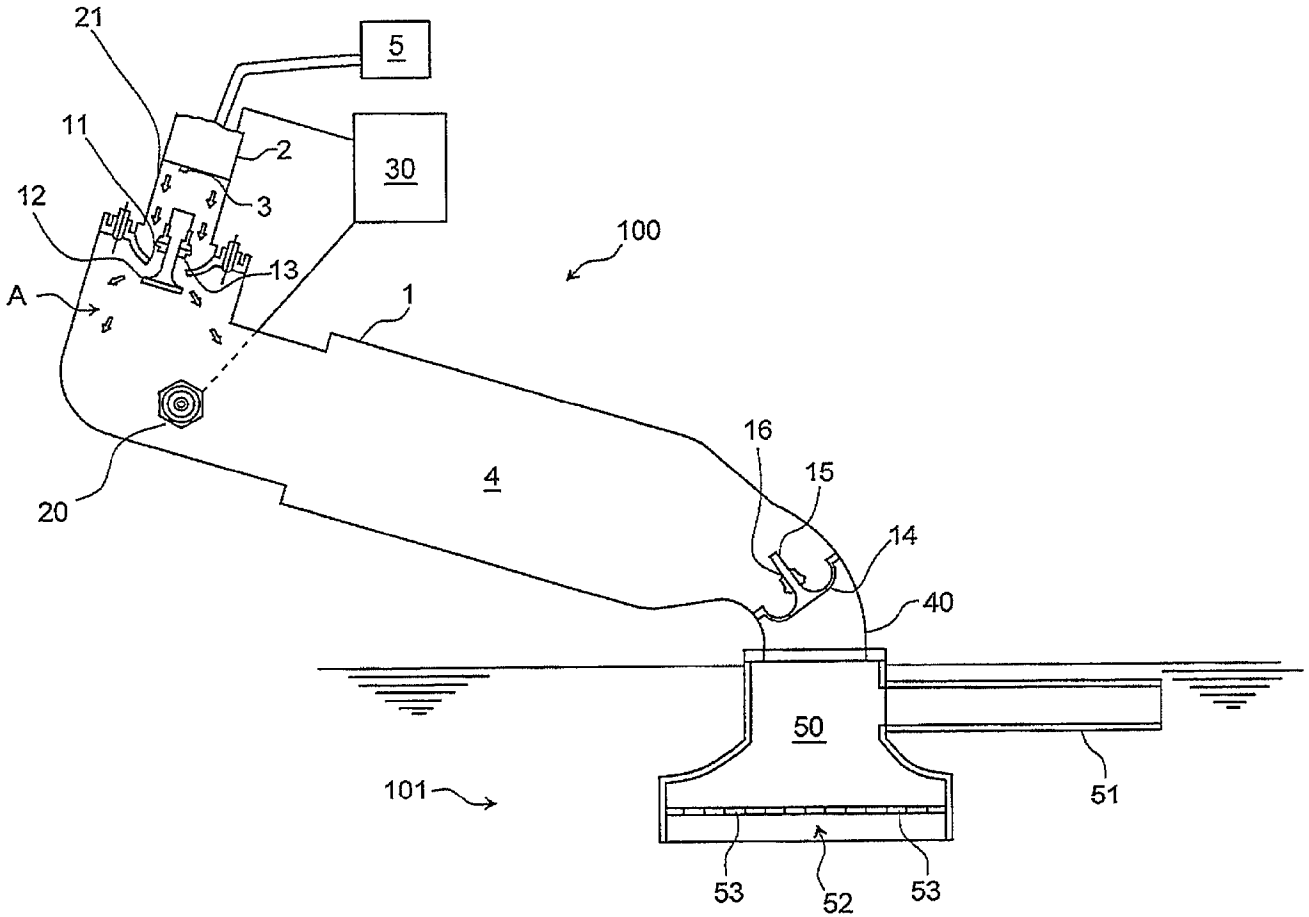
FIGS. 2-5 are diagrammatic vertical section views of the nautical engine in accordance with the present invention during the steps of working.
Figure 3:
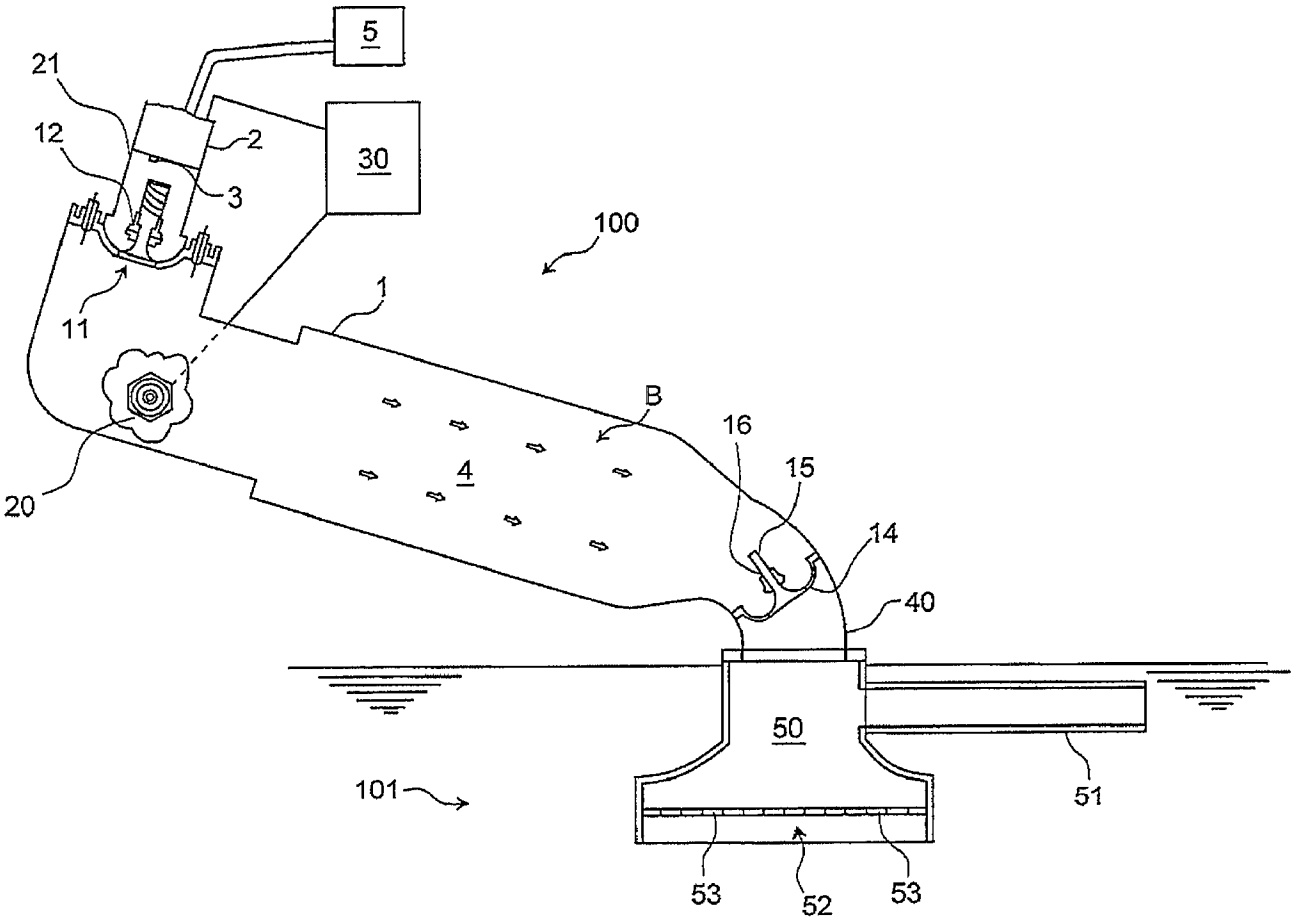
Figure 4:
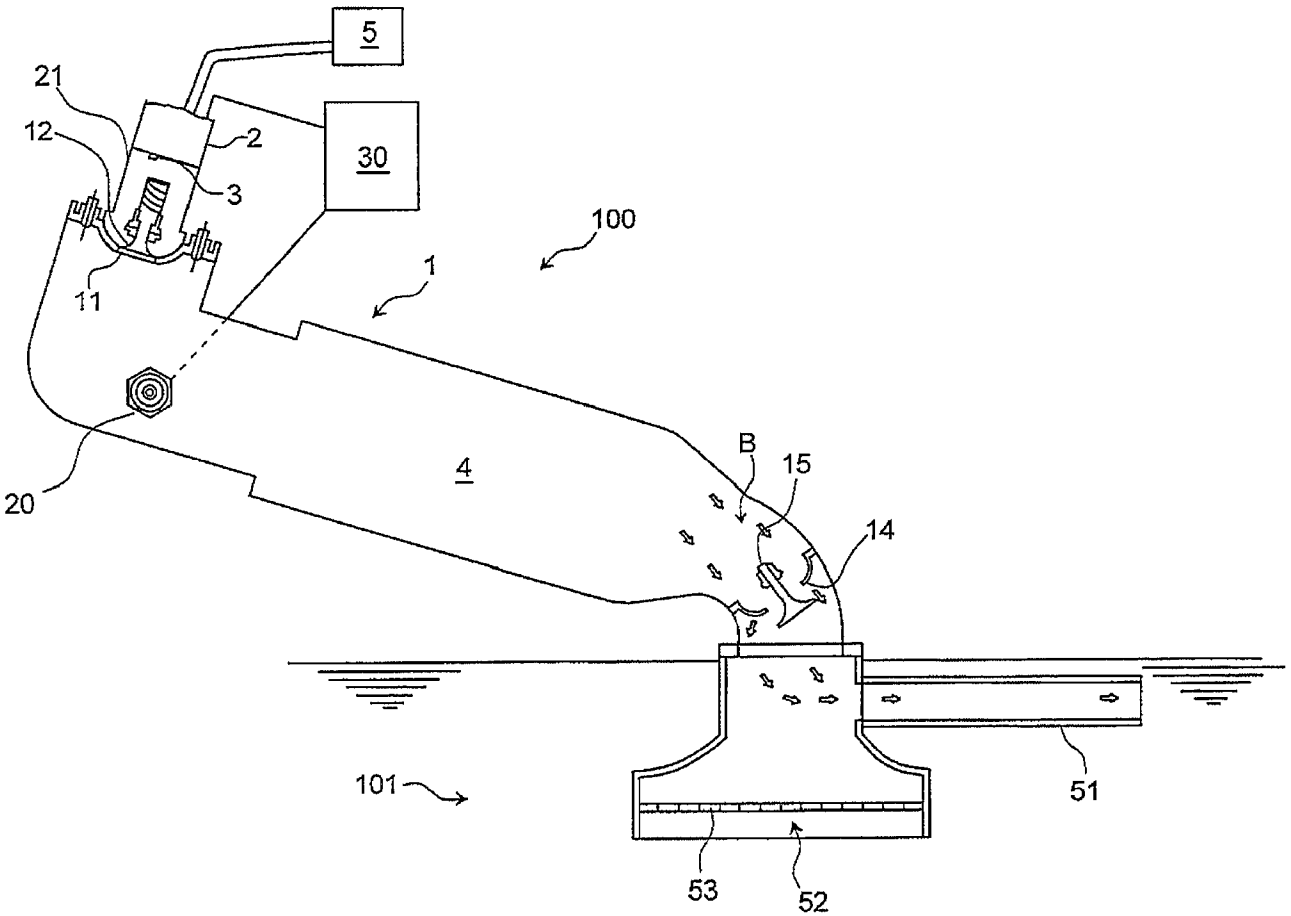
Figure 5:
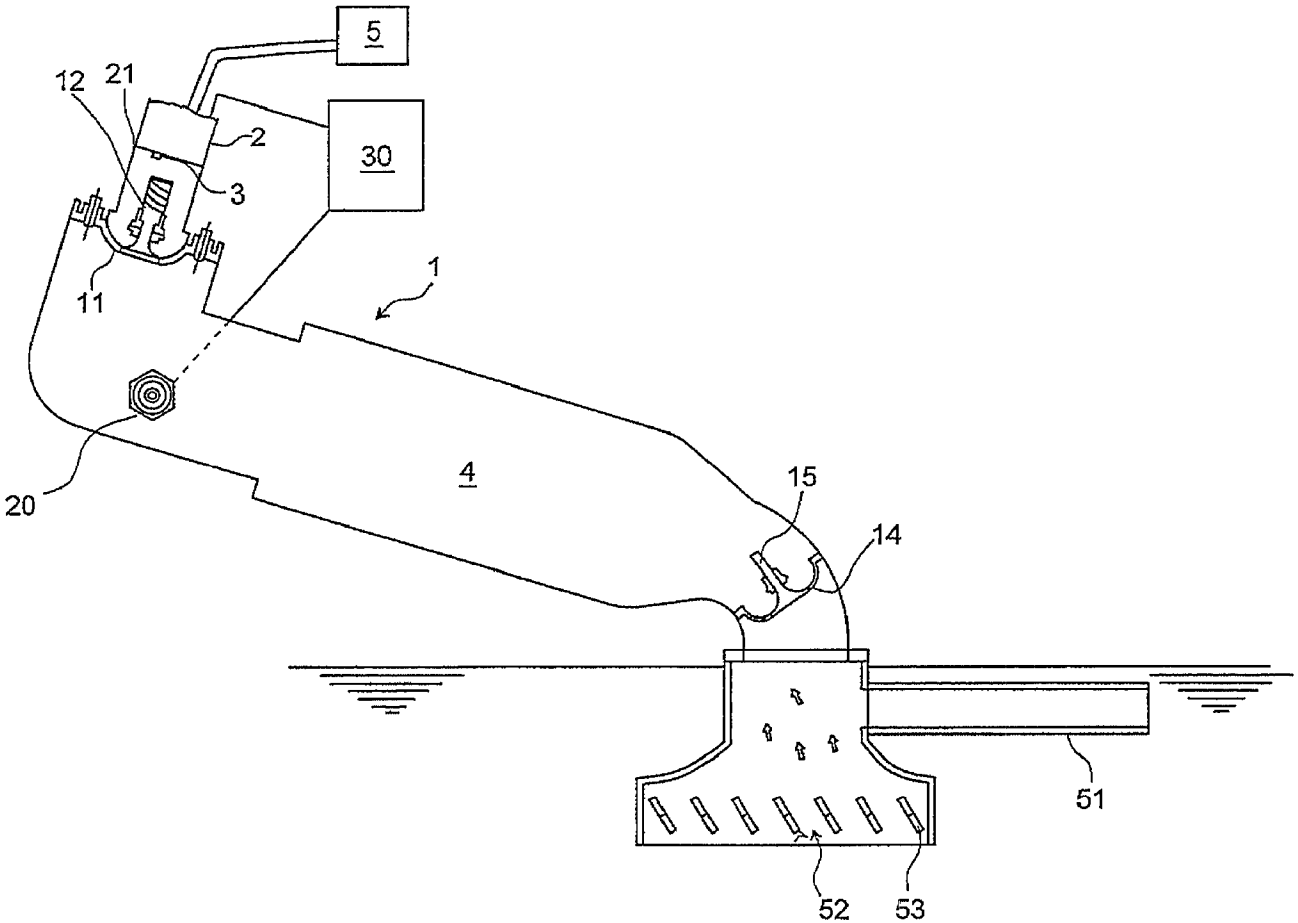

FIGS. 1-5 show a nautical engine in accordance with the present invention. The engine is of the water jet propeller type and comprises a part 100 normally arranged on a boat and a part 101 immersed in the water; the part 100 is the engine part, while the part 101 is the propulsion part which allows to propel the boat.

The engine part 100 comprises two combustion chambers 1 in which a mixture of air and fuel is introduced by means of an injector device 2, of known type, having nozzles 3 for letting out the air and the fuel; the device 2 is fed by the fuel coming from a tank 5 and by the air coming from the outside, preferably filtered by means of a specific cleaner. Specifically, the device 2 is adapted to spray the air and the fuel towards the openings 11 of the chambers 1; a part of the union 21 is adapted to connect the device 2 to both combustion chambers 1.

Each opening 11 of each chamber 1 is normally closed by a valve 12 associated to elastic means 13 which maintain the opening 11 normally closed. The pressure of the air-fuel mixture spray is such to allow the opening of the valve 12 by biasing the elastic means 13; this allows the input of mixture into the chamber 1.

After the air-fuel mixture has been introduced into the chamber 1, the valve 12 closes the opening 11 and combustion occurs by means of a spark emitted by a spark plug 20; both the device 2 and the spark plug 20 are controlled by a control device 30, which determines the spraying frequency of the mixture, the metering of the mixture to be sprayed and the ignition frequency of the spark plug.

The control device 30 is of the electronic type, may be set from the outside and must act so as to control the spark plug ignition with a given delay after the mixture spray command. The control device 30 is powered by a battery and is connected to the device 2 and to the spark plug 20 by means of electric wires. The control device 30 is further adapted to control the feeding and the ignition in the chambers 1 in mutually reciprocating manner. The control device 30 preferably comprises a microprocessor and a memory in which a software is installed and running for setting the feeding frequency of the chambers 1 by acting on the injector, the delay between the feeding of a chamber 1 and the ignition of the spark plug in the same chamber 1. The control device 30 is adapted to control the injector 2 for feeding each chamber 1 after a given interval of time for allowing to exhaust the gas. More precisely, said control device 30 is adapted to feed the mixture into the chamber at regular intervals to allow the combustion of the mixture, the exhausting of the produced gas through the opening 14 and the closing of the opening 14.

The gas produced by the combustion of the air-fuel mixture expands in the chamber 1 and is released through an opening 14, normally closed by a valve 15 associated to elastic means 16 which maintain the opening 14 normally closed. The gas pressure is such to allow the opening of the valve 15 by biasing the elastic means 16 and the release of gas from the chamber 1. After the gas has been released, the valve 15 closes the opening 14.

The gas is released from the engine part 101, which is immersed in the water. The part 101 comprises another open chamber 50 and is connected to the chambers 1 by means of a union 40. The chamber 50 is provided with an exhaust tube 51 and with a part 52 arranged on the bottom of the chamber 50; the part 52 comprises a plurality of rotational segments 53 arranged reciprocally in sequence. The chamber 50 contains water inside and the segments 53 on the side 52 are normally arranged so as to prevent the entrance of water into the chamber 50.

The release of the gas from the chamber 1 causes the release of water only from the tube 51 by means of the pushing action of the gas; in such a manner, the water allows to propel the boat. After the gas has been released from the chamber 1, the valve 15 is closed by the elastic means 16.

The vacuum present in the chamber 50, caused by the action of the thrust of the gas on the water, allows the rotation of the segment 53 on the side 52 for introducing water into the chamber 50.

The part 101 is connected in common to the two chambers 1 and is thus fed with gas in reciprocating manner by the two chambers 1.

The size of the exhaust tube 51 must be such to allow a powerful water jet for propelling the boat. This must be evaluated according to the size of the boat. For example, with a boat 2.60 m in length and 74 cm in width, and with a weight of approximately 100 kg, a good speed is obtained using exhaust pipes 52 with a length of 77 cm and a width of 5 cm. The feeding frequency of the chambers 1 contributes to determine the speed of the boat; the feeding frequency must be preferably 40 shots a minute for each chamber 1. The metered mixture to be injected into the chambers 1 is of known type, i.e. that normally injected in a combustion chamber of a marine engine.

Figure 7:
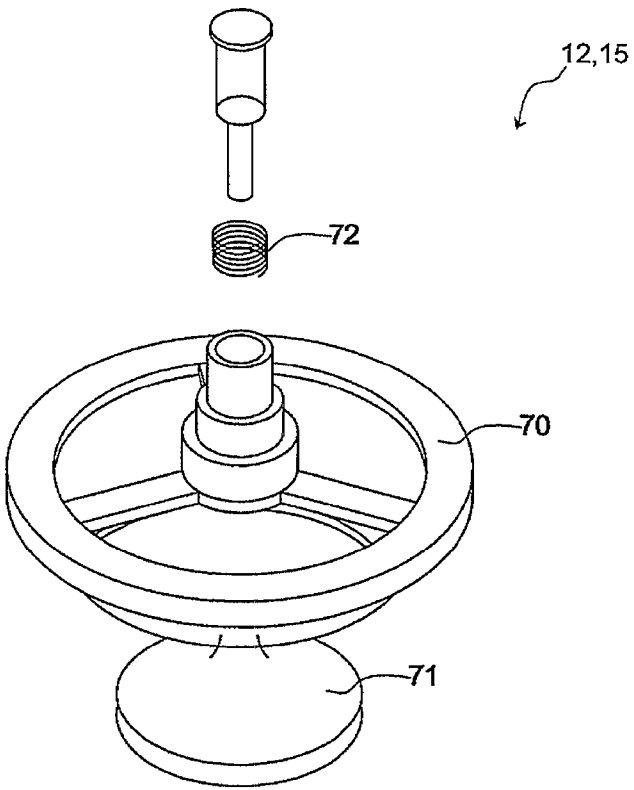
FIG. 7 is an exploded view of the valve in FIG. 6.
Figure 6:
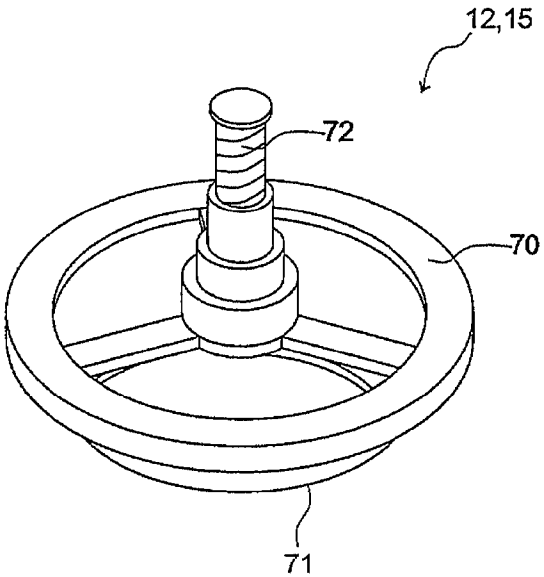
FIG. 6 is a view of a valve used in the nautical engine in accordance with the invention.

FIGS. 6 and 7 describe the valve 12, 15 used to close the openings 11 and 14. The valve comprises a fixed part 70, integral with the corresponding opening 11 or 14, and a mobile part 71, coupled to the fixed part by means of elastic means 72, preferably a spring; the mobile part 71 represents the closing element of the openings 11 and 14. The mobile part 71 normally closes the openings 11 and 14 by the bias of the spring; however, when the pressure of the fluid or of the gas on the mobile part 71 exceeds the action of the spring, the valve opens allowing the passage of the fluid or of the gas. The valves 12 and 15 can be opened by a liquid or a gas which acts on one of them only in a given direction, i.e. by the flow of mixture and of gas. The valves cannot be opened from the inside and from the outside of the combustion chamber in a direction contrary to the flow of the mixture and of the gas, as shown in the FIGS. 2-5.

The invention claimed is:

1. A nautical engine comprising two combustion chambers provided with a first opening, normally closed by a first valve, for feeding an air and fuel mixture into said combustion chambers, at least one spark plug for igniting the mixture, at least one second opening, normally closed by a second valve, for exhausting the exhaust gas derived from the ignition of the mixture, feeding means adapted to feed at least one combustion chamber by means of said at least one first opening, a control device adapted to control said feeding means for feeding the mixture into the combustion chamber and for igniting the spark plug for igniting the mixture, said feeding means comprising a nozzle adapted to spray said mixture at a pressure to open said first valve of the chamber, and, after having closed said first opening of the first valve, said second valve for exhausting the gas can be opened by the gas produced by the ignition of said mixture in the combustion chamber, said combustion chambers being integral with at least one propulsion tube immersed in water and to which the gas from the combustion chamber leads for compressing and expelling the water present in at least one propulsion tube after having closed said second opening of the second valve, said two combustion chambers being fed by mutually reciprocating feeding means, the nautical engine comprising a hollow chamber arranged between said second opening of the combustion chamber and said propulsion tube, said hollow chamber being normally immersed in water and being closed by a segmented element comprising a plurality of rotational segments arranged reciprocally in sequence, said segments opening to let in water due to the vacuum caused by the ejection of exhaust gas through the propulsion tube.

2. The nautical engine according to claim 1, wherein said control means are adapted to control the ignition of the mixture in the combustion chamber with a given delay after the sending of the command to the feeding means for feeding the air-fuel mixture into the combustion chamber.

3. The nautical engine according to claim 1, wherein said first and said second valve can be opened only in the input direction of the flow of the mixture and in the output direction of the exhaust gas from the chamber, respectively.

4. The nautical engine according to claim 3, wherein said first and said second valve comprise a fixed part, integral with the corresponding opening of the combustion chamber, and a mobile part, for closing the opening and elastic means adapted to bias the mobile part to maintain the corresponding opening closed, said mobile part being adapted to open the corresponding opening when the pressure of the air fuel mixture or of the exhaust gas is such to overcome the bias of the spring.

5. The nautical engine according to claim 1, wherein said control device being adapted to control the ignition of the spark plug with a given delay after the feeding of the mixture.

6. The nautical engine according to claim 1, wherein said control device is adapted to control the ignition of the mixture in the chamber at regular intervals to allow the combustion of the mixture, the exhausting of the gas produced through the second opening and the closing of the second opening.

* * * * *